US007533441B2

(12) United States Patent
Yoo

(10) Patent No.: US 7,533,441 B2
(45) Date of Patent: May 19, 2009

(54) AIR PATH CONVERSION VALVE ASSEMBLY FOR VACUUM CLEANER

(75) Inventor: Dong-hun Yoo, Gwangju (KR)

(73) Assignee: Samsung Guangju Electronics Co., Ltd., Guangju (KR)

( * ) Notice: Subject to any disclaimer, the term of this patent is extended or adjusted under 35 U.S.C. 154(b) by 518 days.

(21) Appl. No.: 11/331,872

(22) Filed: Jan. 13, 2006

(65) Prior Publication Data

US 2006/0185115 A1 Aug. 24, 2006

(30) Foreign Application Priority Data

Feb. 23, 2005 (KR) ..... 10-2005-0015077

(51) Int. Cl.
*A47L 9/00* (2006.01)

(52) U.S. Cl. ..... 15/331; 15/334

(58) Field of Classification Search ..... 15/331, 15/334, 338, 412

See application file for complete search history.

(56) References Cited

U.S. PATENT DOCUMENTS 5,351,361 A 10/1994 Buchtel
5,560,074 A 10/1996 Graham et al.
5,732,439 A 3/1998 Cipolla
6,079,077 A * 6/2000 Kajihara et al. ..... 15/332
6,536,074 B2 * 3/2003 Boles et al. ..... 15/331
6,782,585 B1 8/2004 Conrad et al.
7,069,619 B2 * 7/2006 Bowden et al. ..... 15/335
2002/0166196 A1 11/2002 Boles et al.
2003/0024068 A1 2/2003 Tucker

OTHER PUBLICATIONS

British Combined Search and Examination Report dated May 9, 2006 issued in respect to corresponding British Patent Application No. 0603153.8 filed on Feb. 16, 2006.

* cited by examiner

*Primary Examiner*—Dung Van Nguyen
(74) *Attorney, Agent, or Firm*—Ohlandt, Greeley, Ruggiero & Perle, L.L.P.

(57) ABSTRACT

An air path conversion valve assembly of an upright vacuum cleaner, having a duct member mounted to the body of the vacuum cleaner, including a first air path connected with the brush assembly, a second air path connected with a hose, a third air path connected with a suction source of the vacuum cleaner, and a crossing air path in which the first, the second, and the third air paths meet; a valve member pivotably mounted to the crossing air path; a cam unit pivoting the valve member to connect the first air path and the third air path when the body is inclined, and connect the second air path and the third air path when the body is upright; and at least one link member connecting the cam unit and the valve member to transfer a driving force of the cam unit to the valve member.

6 Claims, 9 Drawing Sheets

AIR PATH CONVERSION VALVE ASSEMBLY FOR VACUUM CLEANER

CROSS-REFERENCE TO RELATED APPLICATIONS

This application claims the benefit of Korean Patent Application No. 2005-15077 filed on Feb. 23, 2005, in the Korean Intellectual Property Office, the content of which is incorporated herein by reference in its entirety.

BACKGROUND OF THE INVENTION

1. Field of the Invention

The present invention relates to a vacuum cleaner. More particularly, the present invention relates to an air path conversion valve assembly applied to a vacuum cleaner.

2. Description of the Related Art

The use of an air path conversion valve assembly in an upright vacuum cleaner is generally to change the path of flowing air. Generally, an automatic conversion valve assembly converts the air path to transfer a suction force to a hose when a vacuum cleaner body is in an upright position (hose mode), and converts the air path to transfer a suction force to a brush assembly when the vacuum clear body is inclined to clean a floor (brush mode).

U.S. Patent Application No. 2003/0024068A1 discloses an air path conversion valve assembly in which a brush assembly fluidly communicates with a suction source when a cleaner body is inclined. Because an air path formed in the brush assembly is directly connected with an air path formed in the cleaner body, the connecting portion between the two air paths may be abraded to leak air as the cleaner body is repeatedly inclined. Accordingly, suction force in the connecting portion degrades and the reliability of flow conversion decreases.

U.S. Pat. Nos. 5,732,439 and 6,536,074 also disclose air flow conversion valve assemblies which open and close an air path in a brush assembly, however, these assemblies usually have complicated structures, which leads to increased manufacturing costs.

SUMMARY OF THE INVENTION

The present invention has been conceived to solve the above-mentioned problems occurring in the prior art, and an aspect of the present invention is to provide an air path conversion valve assembly which can conveniently convert to a brush mode and a hose mode.

Another aspect of the present invention is to provide an air path conversion valve assembly having a simple construction.

Yet another aspect of the present invention is to provide an air path conversion valve assembly having a high reliability of conversion operation.

In order to achieve the above aspects, there is provided an air path conversion valve assembly of a vacuum cleaner which is an upright vacuum cleaner having a body pivotably mounted to a brush assembly, comprising a duct member mounted to the pivotable body of the vacuum cleaner, comprising a first air path connected with a brush assembly, a second air path connected with a hose, a third air path connected with a suction source of the vacuum cleaner, and a crossing air path in which the first, the second, and the third air paths connect; a valve member pivotably mounted to the crossing air path, a cam unit pivoting the valve member to connect the first air path and the third air path when the body is inclined, and connect the second air path and the third air path when the body is upright; and at least one link member connecting the cam unit and the valve member to transfer a driving force of the cam unit to the valve member. The cam unit may be mounted on a pivot axis of the body.

The cam unit may comprise a cam diverter movable in a direction of the pivot axis; and a cam guide covering the cam diverter from above, and having a cam profile changing a pivotal movement of the body to a movement of the cam diverter in a lengthwise direction of the pivot axis.

The cam diverter may comprise a cylinder part having at least one protuberance moving along the cam profile; and a protrusion part connected with the link member. The link member may comprise a first link member connected with the protrusion part, and a second link member connecting the first link member and the valve member. The first link member comprises a first connection opening connected with the protrusion part; and a second connection opening connected with the second link member, and a pivot axis of the first link member is located closer to the first connection opening than to the second link opening.

The valve member may comprise a blocking board selectively blocking the first air path or the second air path; and a connection shaft connected with the second link member to rotate the blocking board.

The cam unit may pivot the valve member to connect the first air path and the third air path when the body of the vacuum cleaner is inclined with respect to the brush assembly by 17 degrees or more.

BRIEF DESCRIPTION OF THE DRAWINGS

The above and other aspects, features and advantages of the present invention will be more apparent from the following detailed description taken with reference to the accompanying drawings, in which.

DETAILED DESCRIPTION OF THE INVENTION

Figure 1:
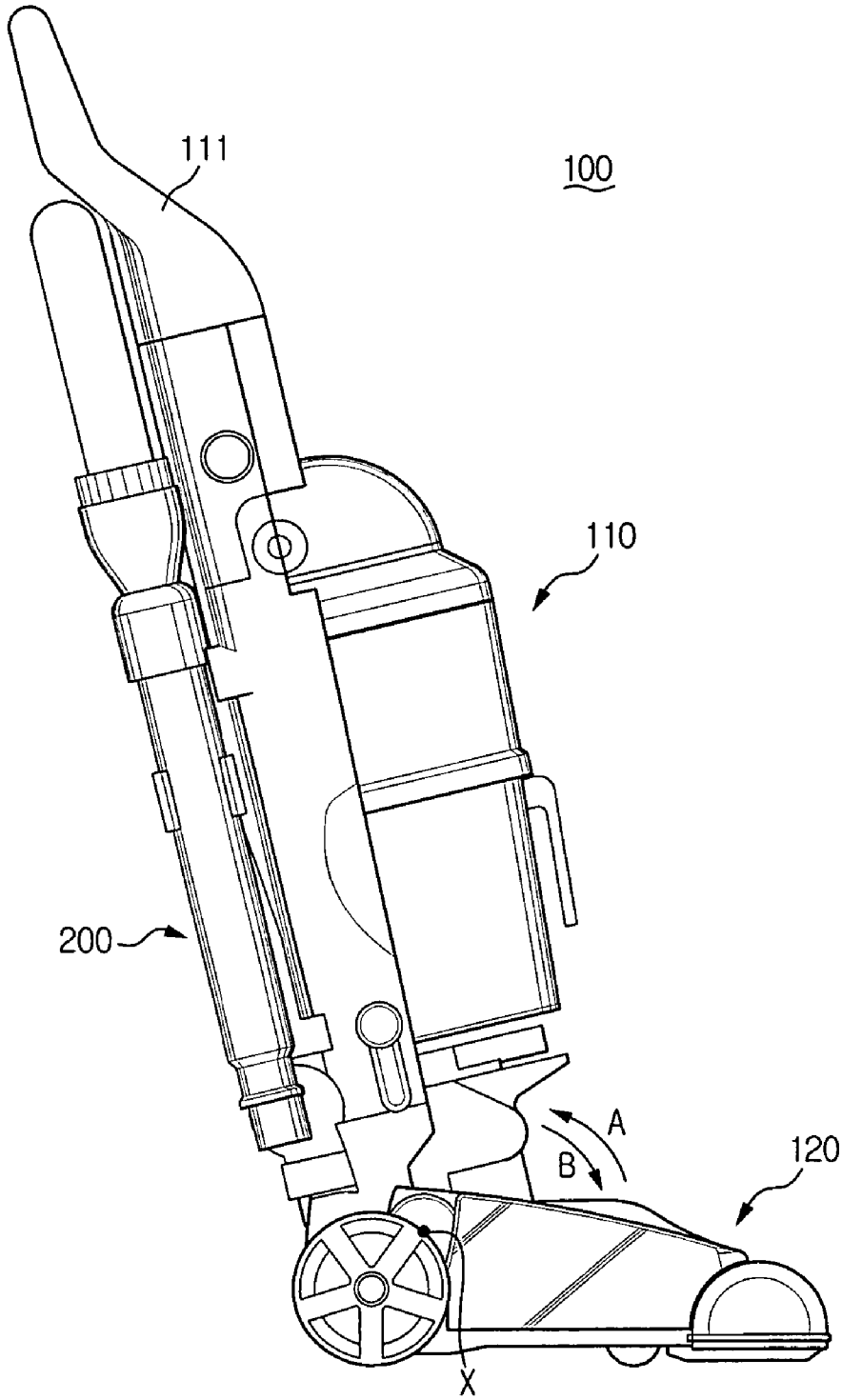
FIG. 1 is a side view of an upright vacuum cleaner applying an air path conversion valve assembly according to an exemplary embodiment of the present invention.

Certain embodiments of the present invention will be described in greater detail with reference to the accompanying drawings.

In the following description, the same drawing reference numerals are used for the same elements throughout the drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
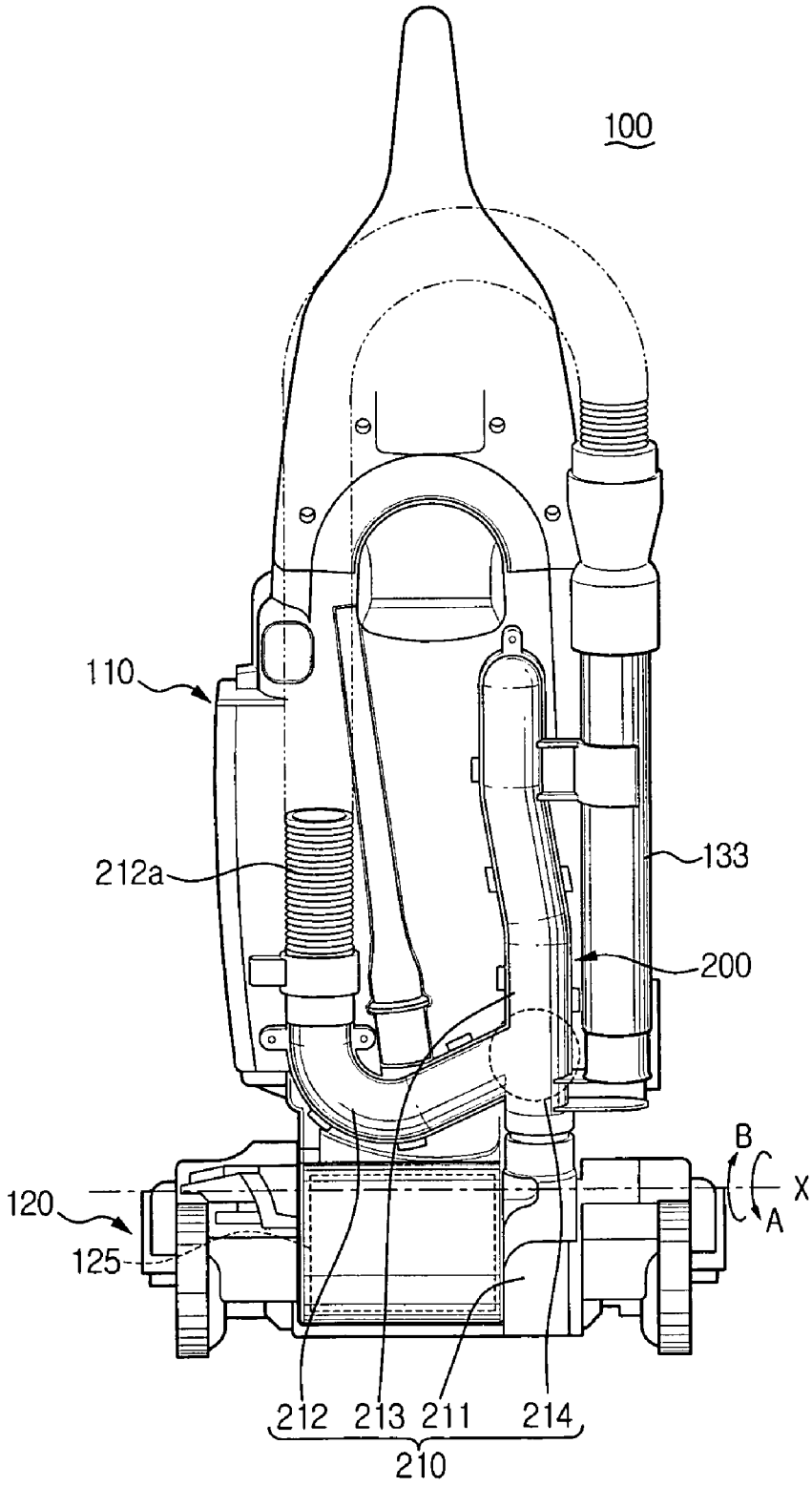
FIG. 2 is a rear view of the upright vacuum cleaner of FIG. 1.

FIG. 1 is a side view of an upright vacuum cleaner applying a valve assembly 200 according to an embodiment of the present invention, and FIG. 2 is a rear view thereof. Referring to FIGS. 1 and 2, an upright vacuum cleaner 100 comprises a body 110, a brush assembly 120 and an air path conversion valve assembly 200.

The body 110 has a dust separating chamber (not shown) therein and a handle 111 provided at an upper part of the body 110 for the grip of a user to move the vacuum cleaner 100. The body 110 is movably mounted to pivot with respect to the brush assembly 120, and more particularly, to pivot in a direction of an arrow A or B based on a pivot axis X. Since the details of the above are not important for the present invention, the detailed description thereof will be omitted.

The upright vacuum cleaner 100 is converted to a brush mode for cleaning a floor when the body 110 is pivoted in the direction of arrow A, and to a hose mode for cleaning an object such as a curtain when the body 110 is pivoted in the direction of arrow B.

The brush assembly 120 comprises an upper housing 121 (refer to FIG. 3) and a lower housing 123 (refer to FIG. 3) receiving the upper housing 121 therein. The lower housing 123 has an air inlet (not shown) allowing contaminants to flow in from the floor. A suction source 125 (refer to FIG. 2) is mounted in the brush assembly 120. Alternatively, the suction source 125 may be mounted in the body 110 if necessary.

Figure 3:
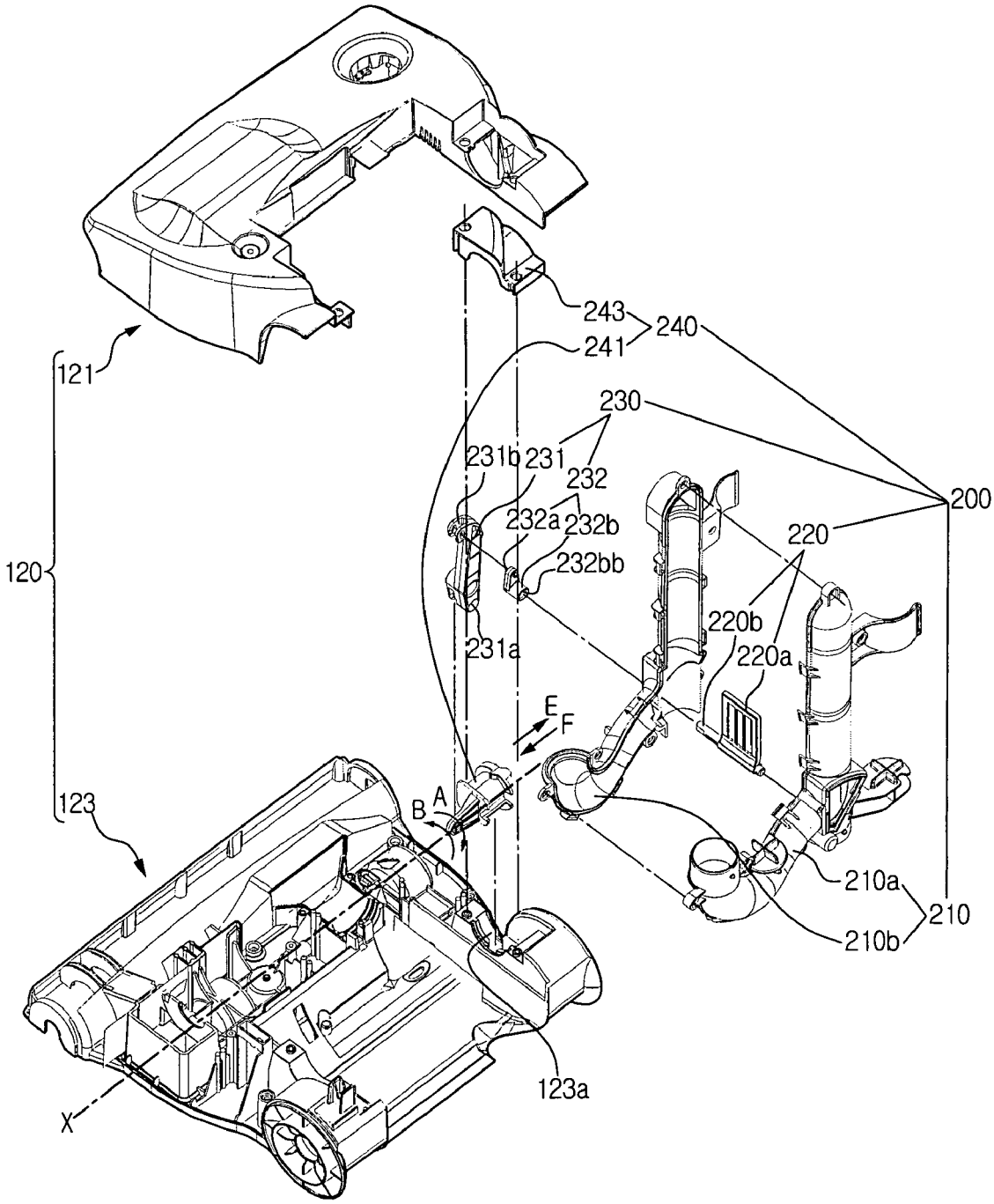
FIG. 3 is an exploded perspective view of a valve assembly and a brush assembly of the upright vacuum cleaner of FIG. 2.

Referring to FIGS. 2 and 3, the air path conversion valve assembly 200 is mounted to a rear side of the body 110 and comprises a duct member 210, a belt member 220, a cam unit 240, and a link member 230.

Figure 5A:
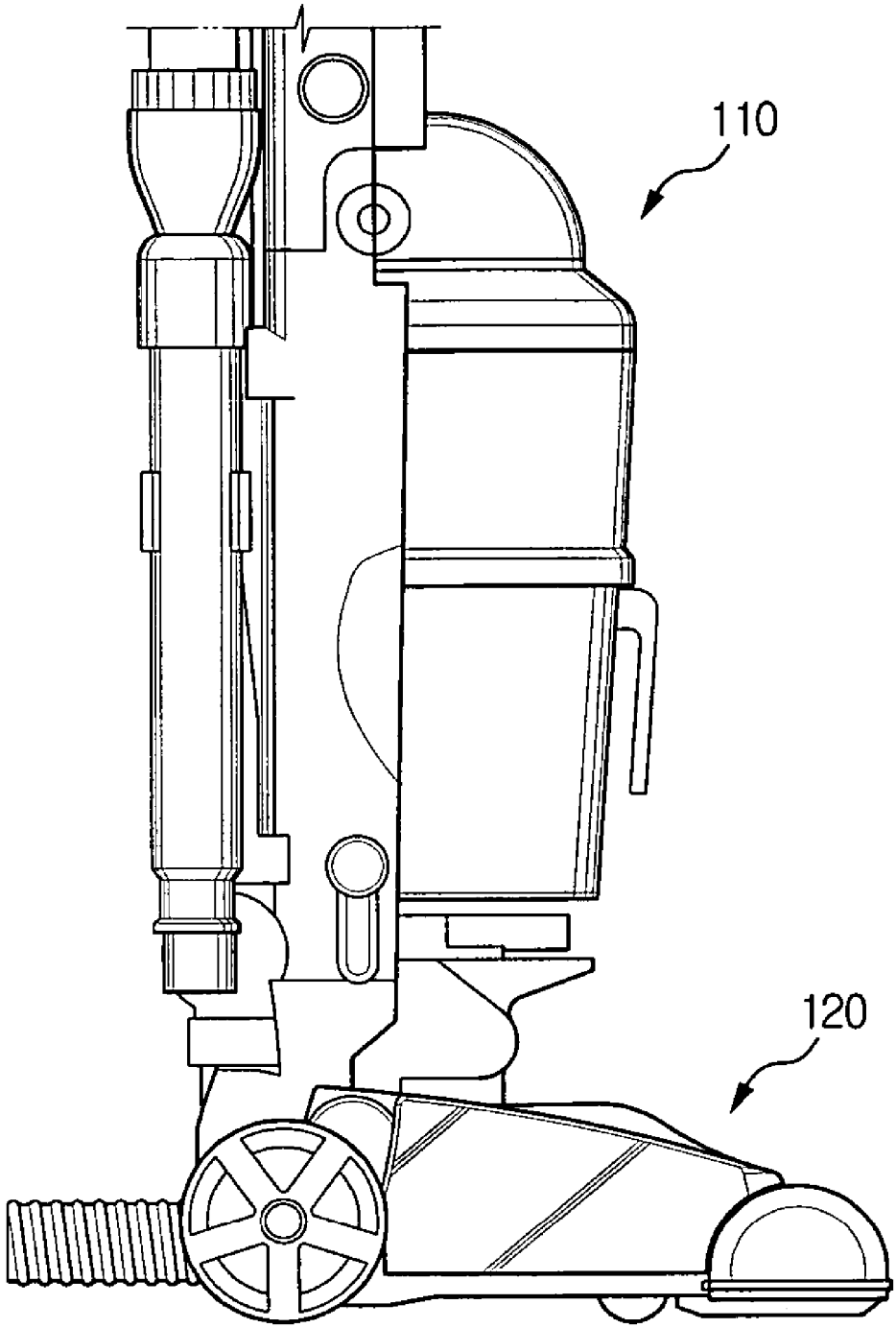
FIGS. 5A, 5B and 5C are views showing operation of an air path conversion valve assembly according to the present invention when converting from a brush mode to a hose mode.

Due to the air path conversion valve assembly 200, a suction force is transferred only to the brush assembly 120 when the body 110 is inclined to clean a floor (refer to FIG. 6A), and only to a hose nozzle 133 when the body 110 is in an upright position to clean a curtain or other object (refer to FIG. 5A). Accordingly, it is convenient to convert the air path since the brush mode and the hose mode can be easily converted just by moving the body 110 to an upright or an inclined position.

The duct member 210 comprises a first air path 211, a second air path 212, a third air path 213, and a crossing air path 214 formed by engaging an upper duct 210*a* and a lower duct 210*b*.

The first air path 211 is a duct of a predetermined length vertically connected with the brush assembly 120. The first air path 211 may be fixed to the brush assembly 120, or alternatively, the first air path 211 may be detachably connected with the brush assembly 120 via a flexible hose.

The second air path 212 is a duct extended in a substantially horizontal direction by a certain length and curved to be connected with the hose nozzle 133. In one preferred embodiment, the second air path 212 comprises a flexible hose 212*a* connected with the hose nozzle 133 (refer to FIG. 2).

The third air path 213 is a duct vertically extended by a certain length to be connected with a suction source 125. The third air path 213 fluidly communicates with the suction source 125 via a dust separating unit (not shown) such as a dust bag or a cyclone dust separating apparatus.

The crossing air path 214 is a duct which connects the first air path 211, the second air path 212 and the third air path 213, and has a valve member 220 therein.

The valve member 220 is pivotably mounted in the crossing air path 214, and comprises a rectangular block board 220*a* selectively blocking the first air path 211 or the second air path 212, and a connection shaft 220*b* which is a pivot axis of the block board 220*a*. The connection shaft 220*b* is engaged with a second link member 232.

Figure 5C:
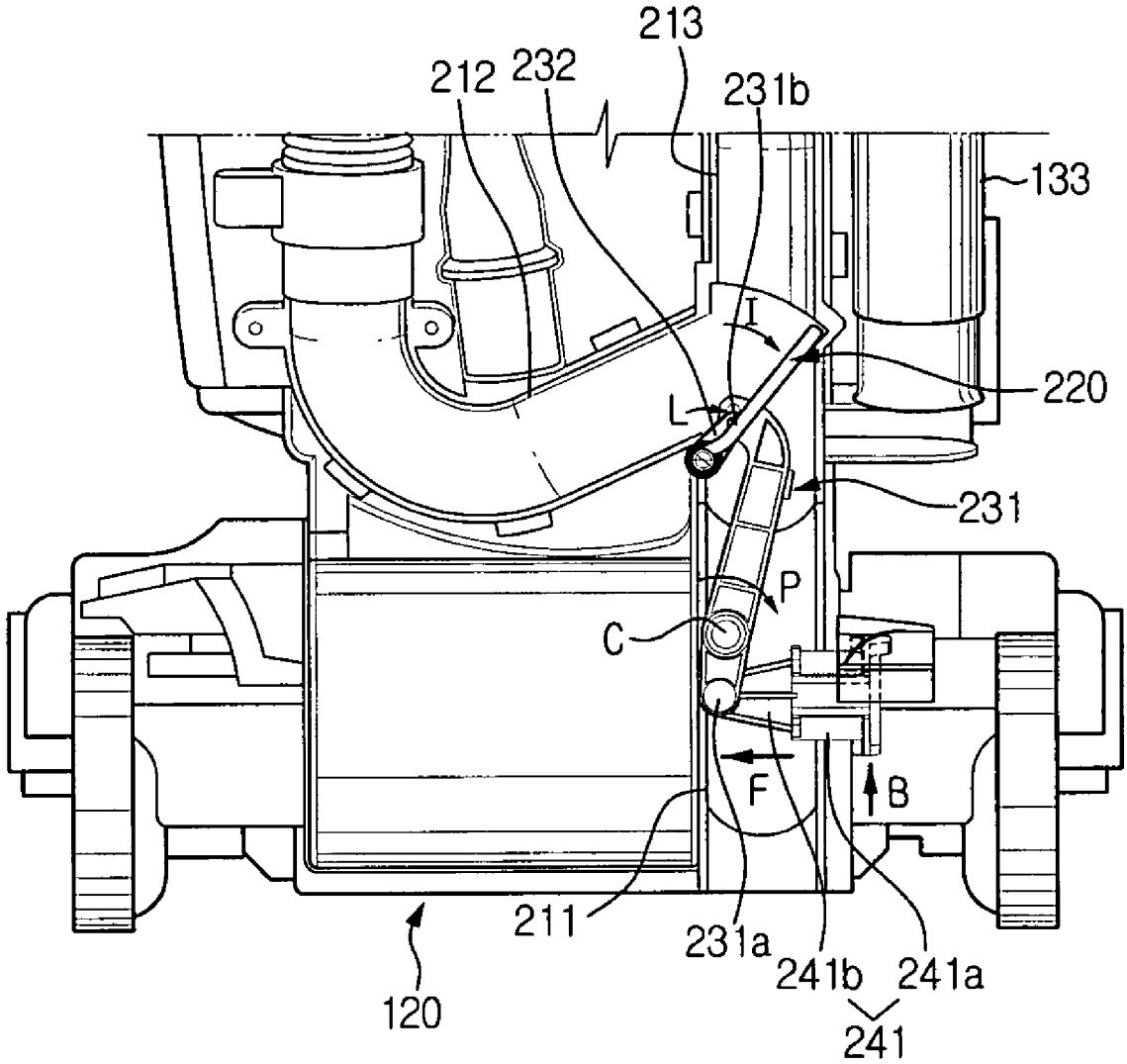
Figure 6A:
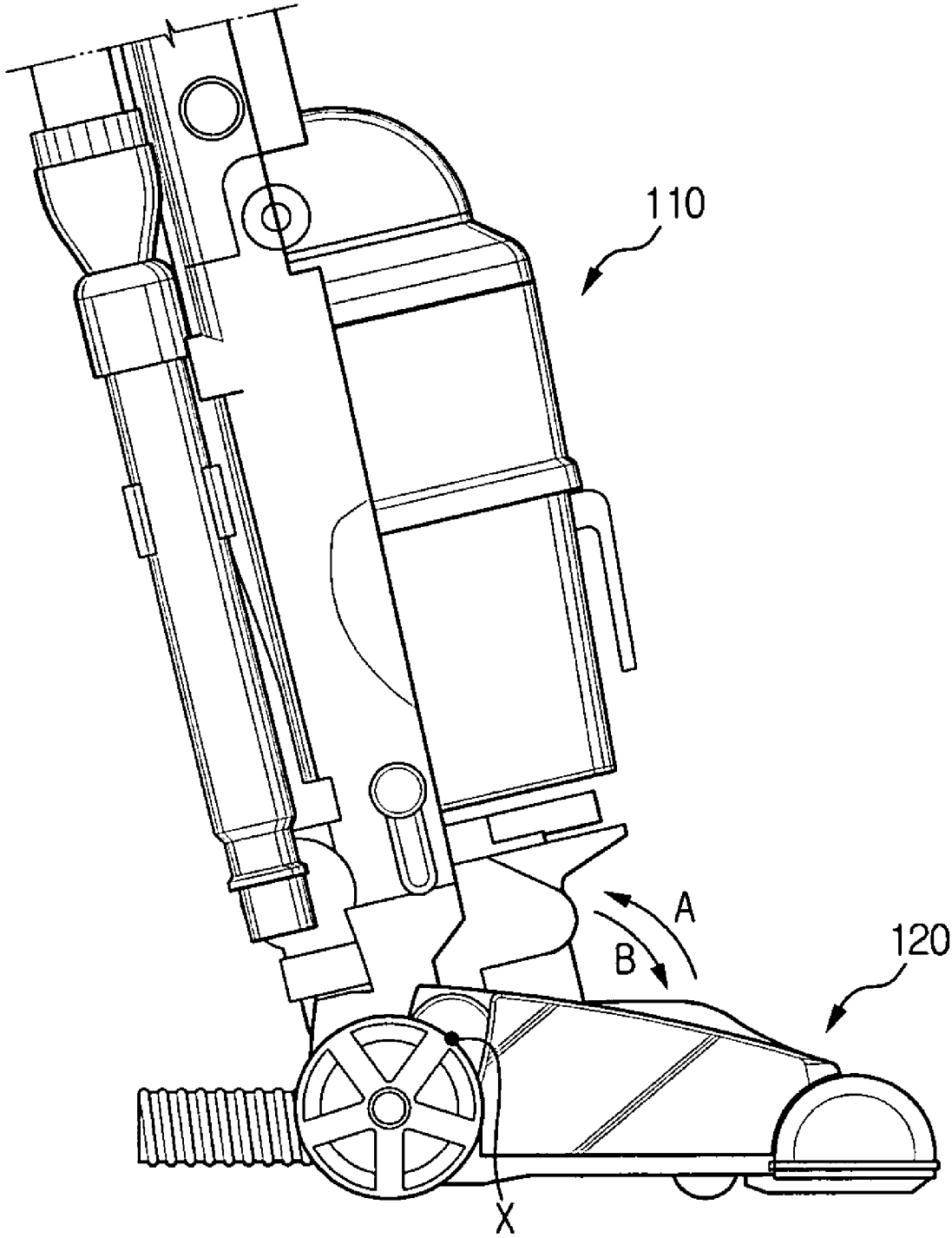
FIGS. 6A, 6B and 6C are views showing operation of a conversation valve assembly according to the present invention when converting from a hose mode to a brush mode.
Figure 6B:
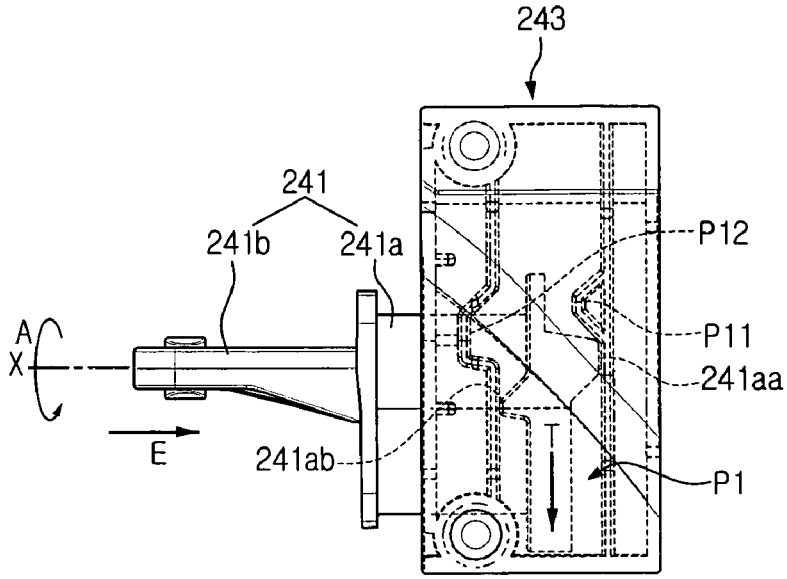
Figure 6C:
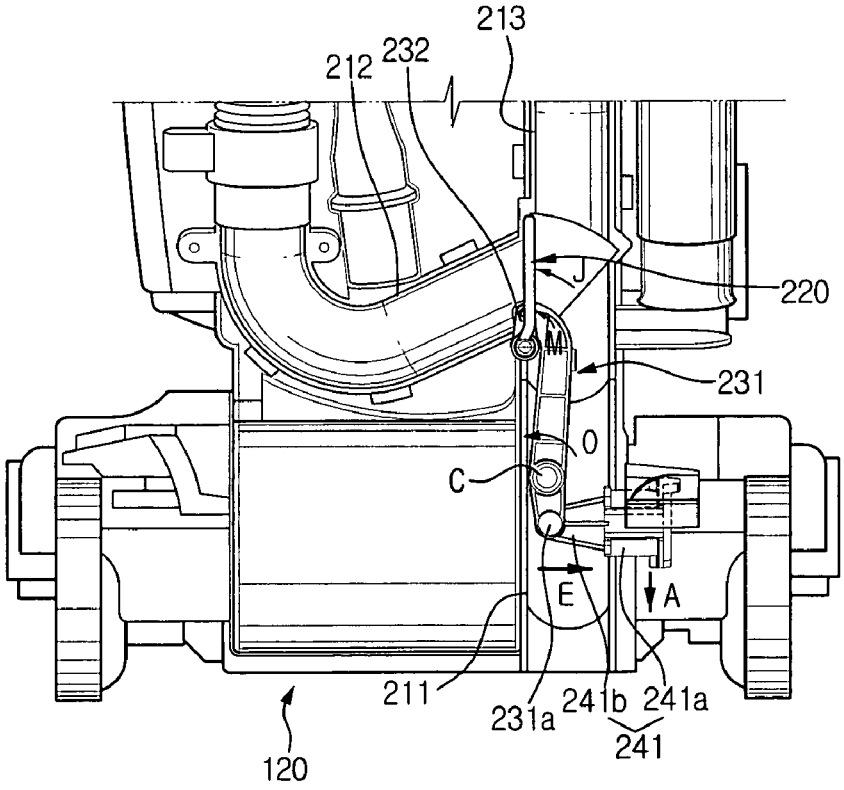

The valve member 220 simultaneously blocks the first air path 211 while connecting the second air path 212 with the third air path 213 (refer to FIG. 5C), or simultaneously blocks the second air path 212 while connecting the first air path 211 with the third air path 213 (refer to FIG. 6C). When the first air path 211 is blocked, and the second air path 212 is simultaneously connected with the third air path 213, a suction force is transferred only to the hose nozzle 133, and when the second air path 212 is blocked, and the first air path 211 is simultaneously connected with the third air path 213, a suction force is transferred only to the brush assembly 120.

The cam unit 240 provides the valve member 220 with a driving force for rotation. The cam unit 240 comprises a cam diverter 241 and a cam guide 243.

The cam diverter 241 is mounted on the pivot axis X, and more particularly, inserted in a cam diverter receiving recess 123*a* of the lower housing 123. When the body 110 pivots in the direction of arrow A or B (refer to FIG. 1), the cam diverter 241 pivots in the same direction. Simultaneously, the cam diverter 241 is moved in a direction of arrow E or F, which is a lengthwise direction of the pivot axis X, by a cam profile P (refer to FIG. 4) formed at the cam guide 243.

Figure 4:
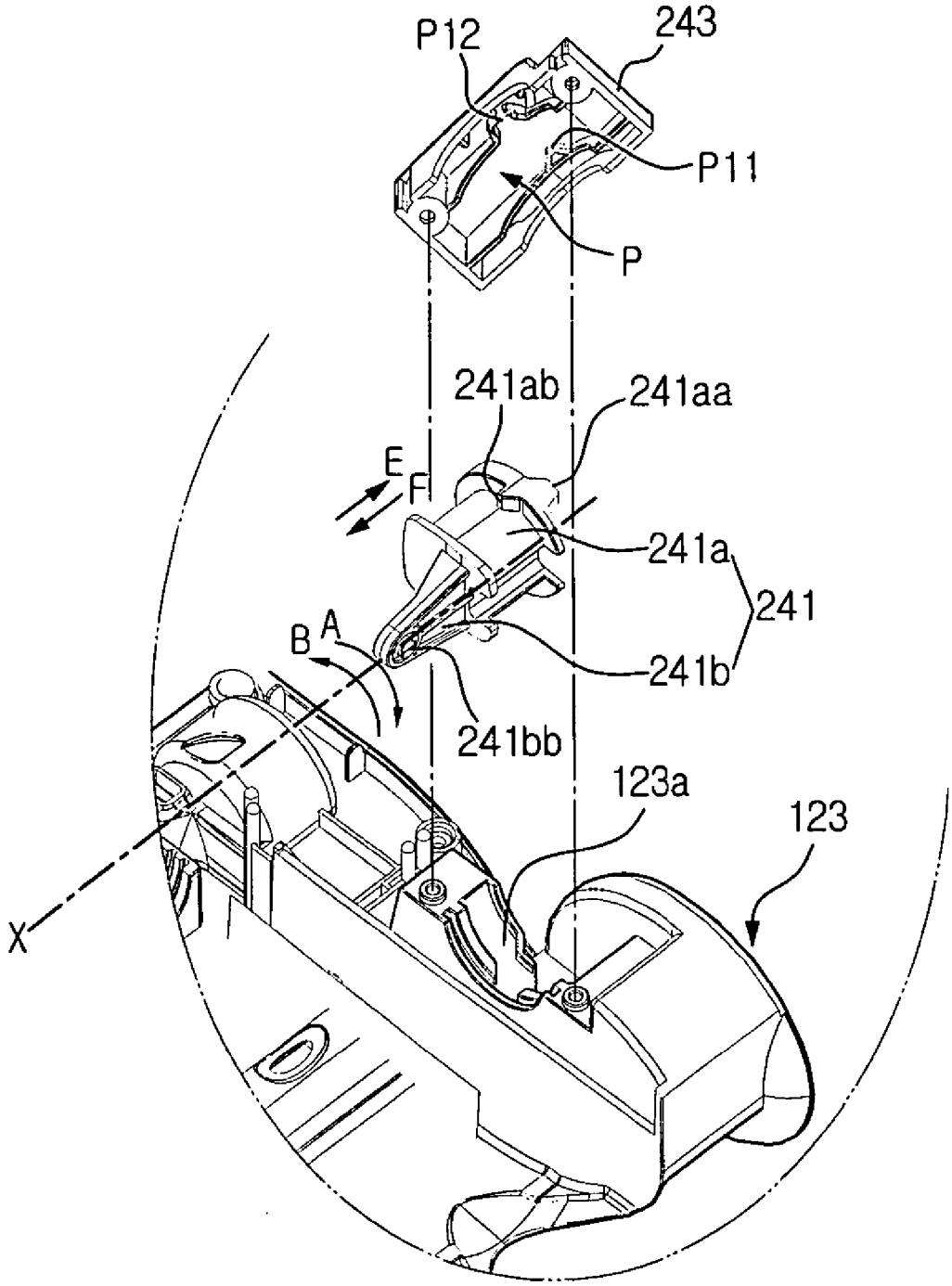
FIG. 4 is an enlarged view of an important portion of a cam unit of the upright vacuum cleaner of FIG. 2.

Referring to FIG. 4, the cam diverter 241 comprises a cylinder part 241*a* and a protrusion part 241*b*. The cylinder part 241*a* is a cylindrical body of the cam diverter 241 which moves along the cam profile P of the cam guide 243. The cylinder part 241*a* comprises an outer protuberance 241*aa* protruded to the outside of the cylinder part 241*a* and an inner protuberance 241*ab* protruded to the inside of the cylinder part 241*a*.

When the cam diverter 241 pivots in the direction of arrow B, the outer protuberance 241*aa* moves over a cam profile protuberance P11 in a direction of arrow V (refer to FIG. 5B), and the inner protuberance 241*ab* is inserted into a cam profile recess P12 in the direction of arrow V (refer to 5B). Therefore, the cam diverter 241 moves in the direction of arrow F (refer to FIG. 5B). When the cam diverter 241 pivots in the direction of arrow A of FIG. 4, the outer protuberance 241*aa* moves down along the cam profile protuberance P11 in a direction of arrow T (refer to FIG. 6B), and the inner protuberance 241*ab* is separated from the cam profile recess P12 in a direction of arrow T (refer to FIG. 6B). Therefore, the cam diverter 241 can move in the direction of arrow E (refer to FIG. 6B).

The protrusion part 241*b* is an approximately triangular body of the cam diverter 241, and has at a vertex a first link member connection protuberance 241*bb* to be connected with the first link member 231.

The cam guide 243 covers the cam diverter 241 from above, and is a cover connected with the lower housing 123. The cam profile P is provided in the bottom surface of the cam guide 243. The cam profile P is a recess for changing the pivot movement in the direction of arrow A or B of the cam diverter 241 of FIG. 4 to the movement in the direction of arrow E or F.

Figure 5B:
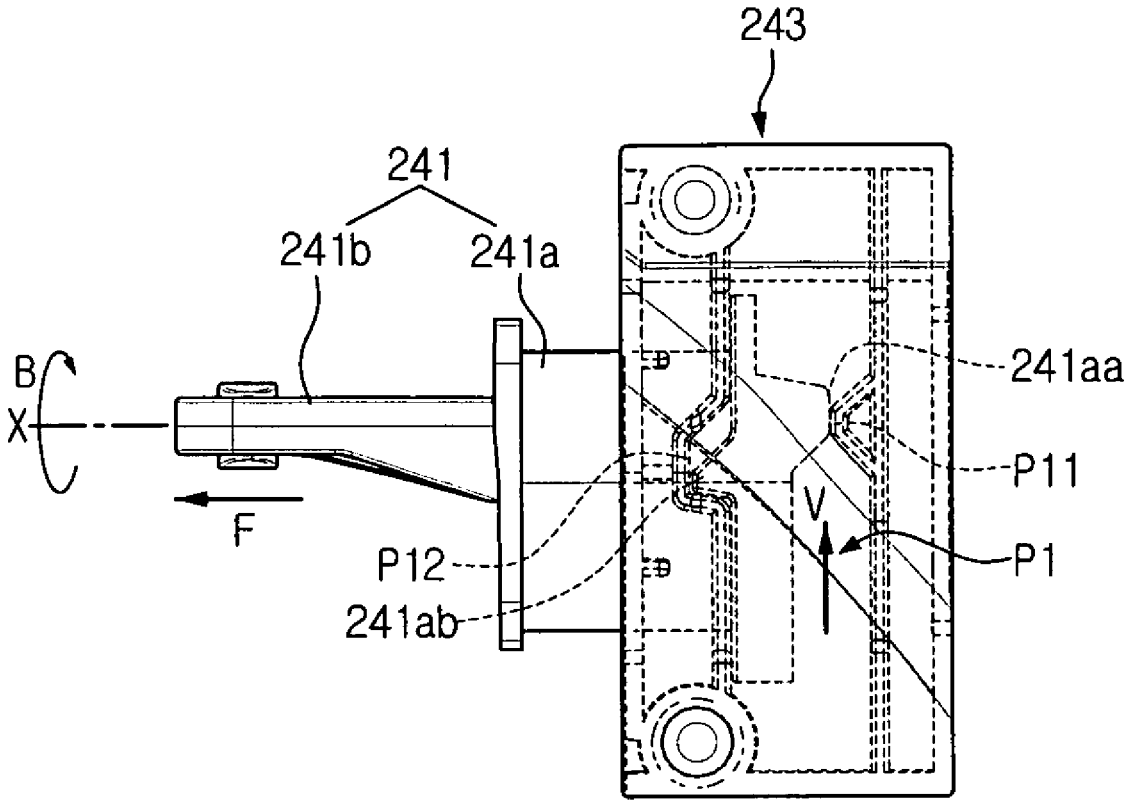

The pivot movement of the cam diverter 241 in the direction of arrow B is changed to the rectilinear movement of the cam diverter 241 in the direction of arrow F (refer to FIG. 5B). The pivot movement of the cam diverter 241 in the direction of arrow A is changed to the rectilinear movement of the cam diverter 241 in the direction of arrow E (refer to FIG. 6B). To this end, the cam profile P comprises the cam profile protuberance P11 contacting the outer protuberance 241*aa* of the cylinder part 241*a*, and the cam profile recess P12 in which the inner protuberance 241*ab* is inserted.

Referring to FIG. 3, the link member 230 comprises the first link member 231 and the second link member 232 which connect the cam unit 240 and the valve member 220 to transfer a driving force of the cam unit 240 to the valve member 220. The first link member 231 and the second link member 232 are mounted to the outside of the duct member 210, and connected with the valve member 220 in the duct member 210.

The first link member 231 comprises a first connection opening 231*a* connected with the first link member connection protuberance 241*bb* (refer to FIG. 4) of the cam diverter 241, and a second connection opening 231*b* connected with the second link member 232. A pivot axis C (refer to FIG. 5C) of the first link member 231 is located closer to the first connection opening 231*a* than to the second connection opening 231*b* to pivot the first link member 231 in a direction of arrow O or P (refer to FIGS. 5C and 6C) in a relatively wider turn by the small movement of the cam diverter 241 in the direction of arrow E or F.

The second link member 232 is a L-shaped link connecting the valve member 220 and the first link member 231, and comprises a flange 232*a* inserted in the second connection opening 231*b* of the first link member 231, and a protrusion part 232*b* protruding from the flange 232*a* and having a connection shaft insertion opening 232*bb* in which the connection shaft 220*b* of the valve member 220 is inserted. As shown in FIGS. 5C and 6C, the first link member 231 transfers the pivotal movement in the direction of arrow P or O to pivot the second link member 232 in a direction of arrow L or M and to finally pivot the valve member 220 in a direction of arrow I or J.

As described above, the air path conversion valve assembly 200 has the duct member 210, the valve member 220, link member 230, and cam unit 240 of relatively simple construction so that construction of the air path conversion valve assembly 200 is simple and manufacturing costs are decreased. Additionally, the conversion can be performed more stably since the air path is reliably converted by the relative connection of the duct member 210, the valve member 220, the link member 230, and the cam unit 240.

Referring to FIGS. 5 and 6, the operation of the air path conversion valve assembly 200 will now be explained.

A user inclines the body 110 in the direction of arrow A from the position shown in FIG. 5A to the position shown in FIG. 6A to use the upright vacuum cleaner 100 in a brush mode.

Referring to FIG. 6B, the cam diverter 241 rotates together with the body 110 in the direction of arrow A since it is mounted on the rotation axis X of the body 110. When the cam diverter 241 rotates in the direction of arrow A, the outer protuberance 241*aa* moves downward along the cam profile protuberance P11 in the direction of arrow T, and the inner protuberance 241*ab* is separated from the cam profile recess P12 in the direction of arrow T. Therefore, the cam diverter 241 moves in the direction of arrow E.

Referring to FIG. 6C, the first link member 231 connected with the protrusion part 241*b* of the cam diverter 241 pivots in the direction of arrow 0 based on the pivot axis C, the second link member 232 connected with the first link member 231 pivots in the direction of arrow M, and finally, the valve member 220 pivots in the direction of arrow J.

The second air path 212 is blocked, and the third air path 213 and the first air path 211 are connected to each other by the valve member 220. Accordingly, suction source 125 (refer to FIG. 2) fluidly communicates with the brush assembly 120 so that a suction force of the suction source 125 (refer to FIG. 2) can be transferred only to the brush assembly 120.

Conversely, a user inclines the body 110 in the direction of arrow B from the position of FIG. 6A to the position of FIG. 5A to use the upright vacuum cleaner 100 in a hose mode.

Referring to FIG. 5B, the cam diverter 241 rotates together with the body 110 in the direction of arrow B since it is mounted on the rotation axis X of the body 110. When the cam diverter 241 rotates in the direction of arrow B, the outer protuberance 241*aa* moves over the cam profile protuberance P11 in the direction of arrow V, and the inner protuberance 241*ab* is inserted into the cam profile recess P12 in the direction of arrow V. Accordingly, the cam diverter 241 can move in the direction of arrow F.

Referring to FIG. 5C, the first link member 231 connected with the protrusion part 241*b* of the cam diverter 241 pivots in the direction of arrow P based on the pivot axis C, the second link member 232 connected with the first link member 231 pivots in the direction of arrow L, and finally, the valve member 220 pivots in the direction of arrow I.

The valve member 220 blocks the first air path 211, and connects the third air path 213 and the second air path 212. Accordingly, the suction source 125 (refer to FIG. 2) fluidly communicates with the hose nozzle 133 so that a suction force of the suction source 125 (refer to FIG. 2) can be transferred only via the hose nozzle 133.

When the body 110 is inclined with respect to the brush assembly 120 more than 17 degrees, a pivot angle of the valve member 220 may be adjusted to connect the first air path 211 and the third air path 213 so that a user can clean a floor in a comfortable angle to move the body 110.

If the air path conversion valve assembly of the upright vacuum cleaner 100 is applied according to an embodiment of the present invention as described above, it is convenient to convert the air path because the upright vacuum cleaner 100 can be used in a brush mode or a hose mode simply by positioning the body in an inclined or an upright position.

Secondly, the construction of the air path conversion valve assembly is simple, which decreases the manufacturing costs, since the air path conversion valve assembly comprises a duct member, a valve member, a link member, and a cam unit of relatively simple construction.

Finally, the reliability of air path conversion is increased by the present invention since the conversion is performed by the relative connection of a duct member, a valve member, a link member, and a cam unit.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An air path conversion valve assembly of an upright vacuum cleaner having a body pivotably mounted to a brush assembly, comprising:

a duct member mounted to the body, the duct member comprising a first air path connected with the brush assembly, a second air path, a third air path connected with a suction source of the vacuum cleaner, and a crossing air path in which the first, the second, and the third air paths connect;

a valve member pivotably mounted to the crossing air path;

a cam unit pivoting the valve member to connect the first air path and the third air path when the body is inclined, and to connect the second air path and the third air path when the body is upright; and at least one link member connecting the cam unit and the valve member to transfer a driving force of the cam unit to the valve member, wherein the cam unit is mounted on a body pivot axis and comprises:

a cam diverter movable in a direction of the body pivot axis; and a cam guide covering the cam diverter, the cam guide having a cam profile changing a pivotal movement of the body to a movement of the cam diverter in a lengthwise direction with respect to the body pivot axis.

2. The air path conversion valve assembly according to claim 1, wherein the cam diverter comprises:

a cylinder part having at least one protuberance moving along the cam profile; and a protrusion part connected with the at least one link member.

3. The air path conversion valve assembly according to claim 2, wherein the at least one link member comprises:

a first link member connected with the protrusion part; and a second link member connecting the first link member and the valve member.

4. The air path conversion valve assembly according to claim 3, wherein the first link member comprises:

a first connection opening connected with the protrusion part; and a second connection opening connected with the second link member, and a link pivot axis of the first link member, the link pivot axis being located closer to the first connection opening than to the second connection opening.

5. The air path conversion valve assembly according to claim 4, wherein the valve member comprises:

a blocking board selectively blocking the first air path or the second air path; and a connection shaft connected with the second link member to rotate the blocking board.

6. The air path conversion valve assembly according to claim 1, wherein the cam unit pivots the valve member to connect the first air path and the third air path when the body of the vacuum cleaner is inclined with respect to the brush assembly by more than 17 degrees.

* * * * *